US010422110B2

(12) United States Patent
Hatanaka et al.

(10) Patent No.: US 10,422,110 B2
(45) Date of Patent: Sep. 24, 2019

(54) PRESSURE COMPENSATION UNIT

(71) Applicant: KAWASAKI JUKOGYO KABUSHIKI KAISHA, Kobe-shi, Hyogo (JP)

(72) Inventors: Yasunori Hatanaka, Kobe (JP); Masahiro Matsuo, Akashi (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 0 days.

(21) Appl. No.: 15/781,180

(22) PCT Filed: Nov. 8, 2016

(86) PCT No.: PCT/JP2016/083083

§ 371 (c)(1),
(2) Date: Jun. 4, 2018

(87) PCT Pub. No.: WO2017/094454

PCT Pub. Date: Jun. 8, 2017

(65) Prior Publication Data

US 2018/0347153 A1 Dec. 6, 2018

(30) Foreign Application Priority Data

Dec. 4, 2015 (JP) ..... 2015-237392

(51) Int. Cl.
*F15B 11/16* (2006.01)
*E02F 9/22* (2006.01)

(52) U.S. Cl.
CPC ..... *E02F 9/2296* (2013.01); *E02F 9/2225* (2013.01); *F15B 11/163* (2013.01);
(Continued)

(58) Field of Classification Search
CPC ..... F15B 11/163; F15B 11/165; F15B 2211/30555
(Continued)

(56) References Cited

U.S. PATENT DOCUMENTS 7,487,707 B2 * 2/2009 Pfaff ..... F15B 11/165 91/437
7,854,115 B2 * 12/2010 Pack ..... F15B 11/163 60/422
(Continued)

FOREIGN PATENT DOCUMENTS

JP 2009-281587 A 12/2009

*Primary Examiner* — Michael Leslie
(74) *Attorney, Agent, or Firm* — Oliff PLC

(57) ABSTRACT

A pressure compensation unit includes: a control valve controlling hydraulic fluid supply and discharge to and from an actuator, the control valve including a pump port, a pair of relay and supply/discharge ports, and a tank port; a pressure compensation valve connected to the relay ports by an upstream and downstream-side relay lines, the pressure compensation valve moving in accordance with a pressure difference between upstream-side relay line and signal pressure; a load pressure detection line branching from the downstream-side relay line; a relief line connected to the downstream-side relay line and having a relief valve; and a switching valve leading: a maximum load pressure to the pressure compensation valve as the signal pressure when the hydraulic fluid does not flow through the relief line; and a pump pressure to the pressure compensation valve as the signal pressure when the hydraulic fluid flows through the relief line.

4 Claims, 4 Drawing Sheets

(52) U.S. Cl.
CPC ... *F15B 11/165* (2013.01); *F15B 2211/20553* (2013.01); *F15B 2211/30555* (2013.01); *F15B 2211/3111* (2013.01); *F15B 2211/6052* (2013.01); *F15B 2211/6055* (2013.01); *F15B 2211/6057* (2013.01); *F15B 2211/651* (2013.01); *F15B 2211/654* (2013.01)

(58) Field of Classification Search
USPC ..... 60/420, 422
See application file for complete search history.

(56) References Cited

U.S. PATENT DOCUMENTS

| | | | | |
|---|---|---|---|---|
| 9,003,786 | B2 * | 4/2015 | Bacon | F15B 11/168 60/422 |
| 10,260,531 | B2 * | 4/2019 | Kondo | F15B 11/165 |
| 2009/0266070 | A1 | 10/2009 | Pack et al. | |

* cited by examiner

PRESSURE COMPENSATION UNIT

TECHNICAL FIELD

The present invention relates to a pressure compensation unit incorporated in a load-sensing hydraulic circuit.

BACKGROUND ART

In a load-sensing hydraulic circuit including a plurality of actuators, the discharge flow rate of a pump is controlled such that the pressure difference between the pump pressure and the maximum load pressure among the load pressures of the respective actuators is constant. Generally speaking, in such a hydraulic circuit, a pressure compensation unit including a pressure compensation valve is provided for each actuator.

For example, Patent Literature 1 discloses pressure compensation units 100 as shown in FIG. 4. Each pressure compensation unit 100 includes a control valve 120, which controls the supply and discharge of a hydraulic fluid to and from an actuator 110. Each pressure compensation unit 100 also includes a shared pump line 101, an auxiliary pump line 102, a maximum load pressure line 103, and a shared tank line 104, which form passages extending across all the pressure compensation units.

The control valve 120 is connected to the shared pump line 101 by a supply line 111, connected to the actuator 110 by a pair of supply/discharge lines 114, and connected to the shared tank line 104 by a discharge line 115. The control valve 120 is also connected to a pressure compensation valve 130 by an upstream-side relay line 112 and a downstream-side relay line 113. The pressure compensation valve 130 is connected to the upstream-side relay line 112 by a first pilot line 131, and connected to a switching valve 140 by a second pilot line 132. The switching valve 140 is connected to the maximum load pressure line 103 by a first signal pressure line 161, and connected to the shared pump line 101 by a second signal pressure line 162.

The maximum load pressure line 103 is connected to the discharge line 115 by a relief line 151. The relief line 151 is provided with a relief valve 152, and also provided with a restrictor 153 positioned upstream of the relief valve 152. The switching valve 140 moves in accordance with the pressure difference between the maximum load pressure and the pressure of the relief line 151 at a position between the restrictor 153 and the relief valve 152.

If the maximum load pressure is lower than the setting pressure of the relief valve 152, the switching valve 140 is positioned in its neutral position, which is the upper position in FIG. 4, and leads the maximum load pressure to the pressure compensation valve 130. Accordingly, the pressure compensation valve 130 moves in accordance with the pressure difference between the pressure of the upstream-side relay line 112 and the maximum load pressure, and serves to keep constant the pressure difference between the upstream and downstream sides of the restrictor of the control valve 120 (i.e., the pressure difference between the pump pressure and the pressure of the upstream-side relay line 112). Therefore, even when the maximum load pressure varies, the flow rate of the hydraulic fluid supplied to the actuator 110 is kept constant.

On the other hand, if the maximum load pressure is higher than the setting pressure of the relief valve 152, the switching valve 140 shifts to a pressure-restricting position, which is the lower position in FIG. 4, and leads the pump pressure to the pressure compensation valve 130. Accordingly, the pressure compensation valve 130 blocks the upstream-side relay line 112 and the downstream-side relay line 113. Therefore, the load pressure of the actuator 110 can be kept to a desired pressure or lower. It should be noted that in a ease where a relief valve is provided on each of the supply/discharge lines 114 connected to the actuator 110, and the hydraulic fluid to the actuator is directly controlled by these relief valves, the flow rate of the hydraulic fluid flowing through the relief valves becomes significantly high, which causes a problem where a necessary flow rate for another actuator cannot be delivered.

CITATION LIST

Patent Literature

PTL 1: Japanese Laid-Open Patent Application Publication No. 2009-281587

SUMMARY OF INVENTION

Technical Problem

In the pressure compensation unit 100 disclosed in Patent Literature 1, even when the control valve of the pressure compensation unit 100 is in its neutral position, if the load pressure of an actuator corresponding to another pressure compensation unit incorporated in the same hydraulic circuit exceeds the setting pressure of the relief valve 152, the hydraulic fluid flows through the relief valve 152. Thus, an unnecessary flow occurs in the non-operating pressure compensation unit 100, which causes energy loss.

In view of the above, an object of the present invention is to provide a pressure compensation unit that makes it possible to keep the load pressure of an actuator to a desired pressure or lower and prevent the occurrence of an unnecessary flow in the pressure compensation unit when the pressure compensation unit is not operating.

Solution to Problem

In order to solve the above-described problems, a pressure compensation unit according to the present invention includes: a control valve that controls supply and discharge of a hydraulic fluid to and from an actuator, the control valve including a pump port, a pair of relay ports, a pair of supply/discharge ports, and a tank port; a pressure compensation valve connected to the pair of relay ports by an upstream-side relay line and a downstream-side relay line, the pressure compensation valve moving in accordance with a pressure difference between a pressure of the upstream-side relay line and a signal pressure; a load pressure detection line that branches off from the downstream-side relay line; a relief line connected to the downstream-side relay line and provided with a relief valve; and a switching valve configured to: lead a maximum load pressure to the pressure compensation valve as the signal pressure when the hydraulic fluid does not flow through the relief line; and lead a pump pressure to the pressure compensation valve as the signal pressure when the hydraulic fluid flows through the relief line.

According to the above configuration, if the pressure of the downstream-side relay line, i.e., the load pressure of the actuator, is lower than the setting pressure of the relief valve, the maximum load pressure is led to the pressure compensation valve as the signal pressure. Accordingly, the pressure difference between the pressure of the upstream-side relay line and the maximum load pressure is kept constant by the pressure compensation valve. Therefore, even when the maximum load pressure varies, the flow rate of the hydraulic fluid supplied to the actuator is kept constant. On the other hand, if the load pressure of the actuator is higher than the setting pressure of the relief valve, the pump pressure is led to the pressure compensation valve as the signal pressure. Therefore, the load pressure of the actuator can be kept to a desired pressure or lower. Moreover, since the relief line provided with the relief valve is connected to the downstream-side relay line, in a case where a plurality of pressure compensation units are present, even when one actuator (pressure compensation unit) is not operating and another actuator (pressure compensation unit) is operating, the load pressure of the other actuator is not applied to the relief valve of the one actuator. This eliminates a problem where the hydraulic fluid of the operating pressure compensation unit flows through the relief valve of the non-operating pressure compensation unit and is discharged. Thus, energy loss can be prevented.

The relief line may be provided with a restrictor positioned upstream of the relief valve. The switching valve may be connected to the downstream-side relay line by a first pilot line, and connected to the relief line by a second pilot line at a position between the restrictor and the relief valve. According to this configuration, the switching valve can be moved automatically.

The pressure of the upstream-side relay line may be led to the pressure compensation valve through a pilot line. The pressure compensation unit may further include: a bypass line that connects between the pilot line and the downstream-side relay line; and a bypass valve provided on the bypass line and configured to keep constant a flow rate of the hydraulic fluid that flows through the bypass line. According to this configuration, increase in the load pressure of the actuator can be kept small assuredly.

Advantageous Effects of Invention

The present invention realizes a pressure compensation unit that makes it possible to keep the load pressure of an actuator to a desired pressure or lower and prevent the occurrence of an unnecessary flow in the pressure compensation unit when the pressure compensation unit is not operating.

DESCRIPTION OF EMBODIMENTS

Embodiment 1

Figure 1:
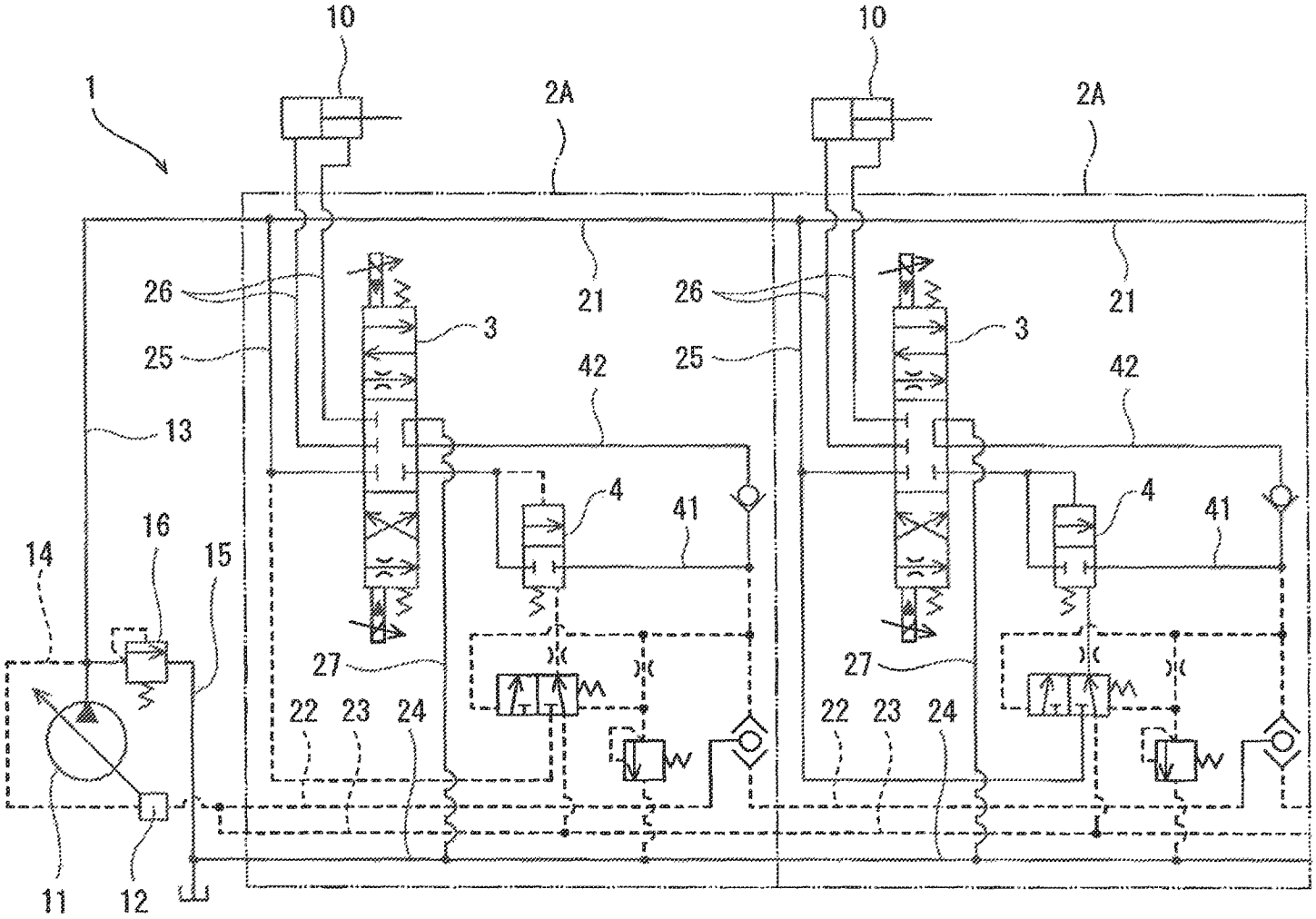
FIG. 1 shows a schematic configuration of a hydraulic circuit, in which pressure compensation units according to Embodiment 1 of the present invention are incorporated.
Figure 2:
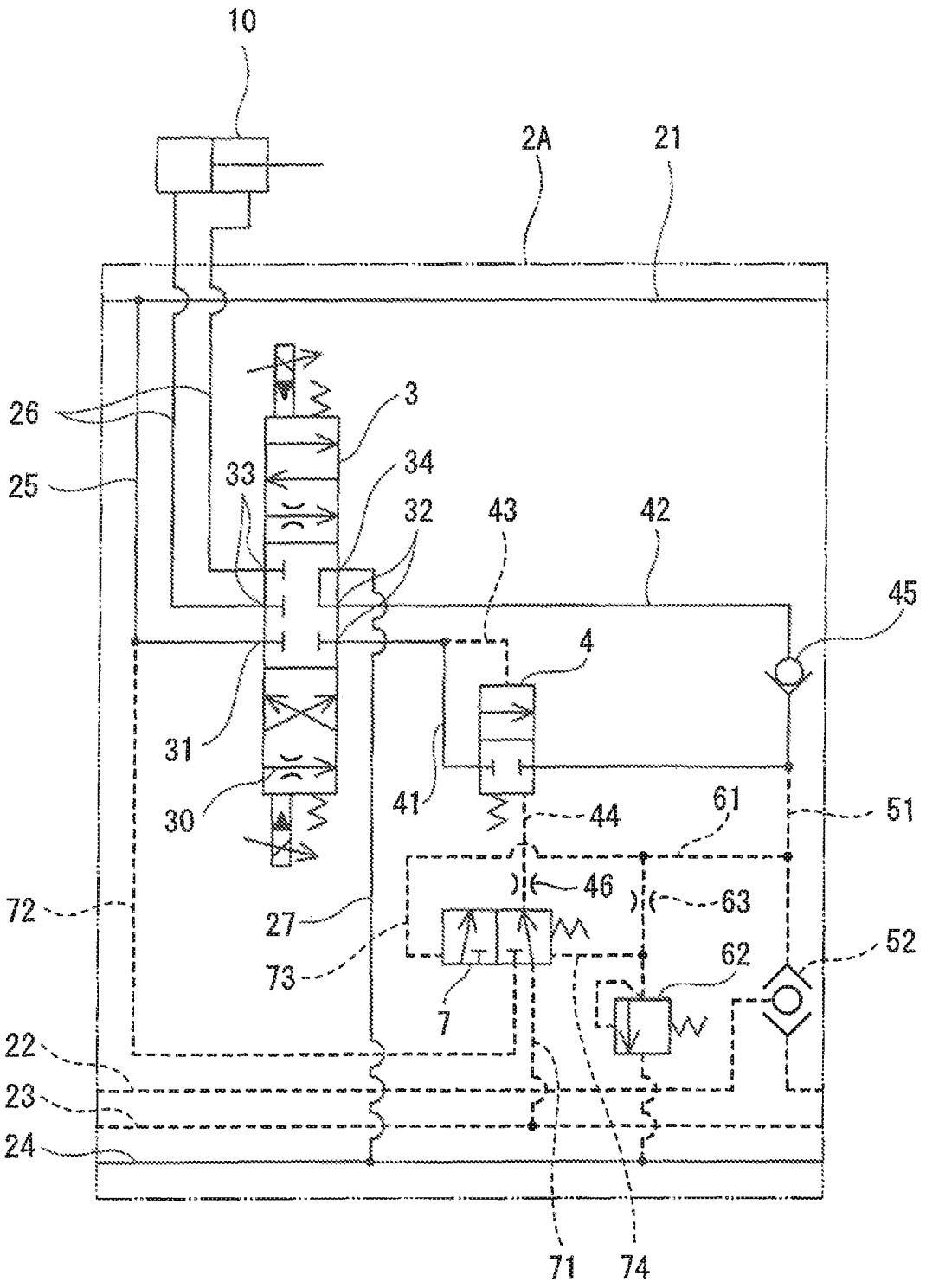
FIG. 2 shows a schematic configuration of the pressure compensation unit of FIG. 1.

FIG. 2 shows a pressure compensation unit 2A according to Embodiment 1 of the present invention. FIG. 1 shows a hydraulic circuit 1, in which a plurality of pressure compensation units 2A are incorporated. Although FIG. 1 shows only two pressure compensation units 2A, the number of pressure compensation units 2A may be three or more.

Each pressure compensation unit 2A includes a shared pump line 21, a maximum load pressure line 23, and a shared tank line 24. Between the adjacent pressure compensation units 2A, lines corresponding to each other (shared pump lines 21, maximum load pressure lines 23, and shared tank lines 24) are connected to each other. In this manner, passages extending across all the pressure compensation units 2A are formed.

The shared pump line 21 of the pressure compensation unit 2A at the end is connected to a variable displacement pump 11 by a discharge line 13. A relief line 15 branches off from the discharge line 13, and the relief line 15 is connected to a tank. The relief line 15 is provided with a relief valve 16.

The discharge flow rate of the pump 11 is controlled by a regulator 12. A discharge pressure detection line 14, which branches off from the discharge line 13, is connected to the regulator 12. The maximum load pressure line 23 of the pressure compensation unit 2A at the end is also connected to the regulator 12. The regulator 12 controls the discharge flow rate of the pump 11, such that a pressure difference $\Delta P$ between a pump pressure Pp led through the discharge pressure detection line 14 and a maximum load pressure PLm led through the maximum load pressure line 23 is constant.

Each pressure compensation unit 2A includes a control valve 3, which controls the supply and discharge of a hydraulic fluid (e.g., hydraulic oil) to and from an actuator 10. The actuator 10 may be a hydraulic cylinder or may be a hydraulic motor.

As shown in FIG. 2, the control valve 3 includes a pump port 31, a pair of relay ports 32, a pair of supply/discharge ports 33, and a tank port 34. The pump port 31 is connected to the shared pump line 21 by a supply line 25, and the pair of relay ports 32 is connected to a pressure compensation valve 4 by an upstream-side relay line 41 and a downstream-side relay line 42. The pair of supply/discharge ports 33 is connected to the actuator 10 by a pair of supply/discharge lines 26, and the tank port 34 is connected to the shared tank line 24 by a discharge line 27.

When the control valve 3 is positioned in its neutral position, the control valve 3 blocks the supply line 25, the upstream-side relay line 41, and the pair of supply/discharge lines 26, and brings the downstream-side relay line 42 into communication with the discharge line 27. When the control valve 3 moves, the supply line 25 comes into communication with the upstream-side relay line 41; the downstream-side relay line 42 comes into communication with one of the pair of supply/discharge lines 26; and the other one of the pair of supply/discharge lines 26 comes into communication with the discharge line 27. A passage 30 in the control valve 3, the passage 30 being interposed between the supply line 25 and the upstream-side relay line 41, functions as a restrictor.

In each pressure compensation unit 2A, a load pressure detection line 51 branches off from the downstream-side relay line 42. The downstream-side relay line 42 is provided with a check valve 45, which is positioned downstream of a branch point where the load pressure detection line 51 branches off from the downstream-side relay line 42.

A high pressure selective valve 52 is connected to the distal end of the load pressure detection line 51. Between the adjacent pressure compensation units 2A, their high pressure selective valves 52 are connected to each other by a high pressure selective line 22. In other words, the hydraulic circuit 1 is configured such that the maximum load pressure PLm among load pressures PL of the respective actuators 10 is detected. The high pressure selective line 22 of the pressure compensation unit 2A at the end is connected to the maximum load pressure line 23 outside the pressure compensation unit 2A. That is, the maximum load pressure PLm is led from the high pressure selective line 22 of the pressure compensation unit 2A at the end to the regulator 12 through the maximum load pressure line 23.

The aforementioned pressure compensation valve 4 is connected to the upstream-side relay line 41 by a first pilot line 43, and connected to a switching valve 7 by a second pilot line 44. The second pilot line 44 is provided with a restrictor 46.

The pressure compensation valve 4 moves in accordance with the pressure difference between the pressure of the upstream-side relay line 41 led through the first pilot line 43 and a signal pressure led through the second pilot line 44. If the sum of a pressure corresponding to the spring force and the signal pressure is higher than the pressure of the upstream-side relay line 41, the pressure compensation valve 4 blocks the upstream-side relay line 41 and the downstream-side relay line 42. If the sum of the pressure corresponding to the spring force and the signal pressure is lower than the pressure of the upstream-side relay line 41, the pressure compensation valve 4 brings the upstream-side relay line 41 into communication with the downstream-side relay line 42.

The switching valve 7 switches the signal pressure led to the pressure compensation valve 4 between the maximum load pressure PLm and the pump pressure Pp. The switching valve 7 is connected to the maximum load pressure line 23 by a first signal pressure line 71, and connected to the supply line 25 by a second signal pressure line 72. Alternatively, the switching valve 7 may be connected to the shared pump line 21 by the second signal pressure line 72.

A relief line 61 branches off from the aforementioned load pressure detection line 51. In other words, the relief line 61 is connected to the downstream-side relay line 42 via the load pressure detection line 51. However, as an alternative, the relief line 61 may be directly connected to the downstream-side relay line 42. The relief line 61 is also connected to the shared tank line 24. The relief line 61 is provided with a relief valve 62 and a restrictor 63. The restrictor 63 is positioned upstream of the relief valve 62.

The switching valve 7 is configured to: lead the maximum load pressure PLm to the pressure compensation valve 4 as the signal pressure when the hydraulic fluid does not flow through the relief line 61; and lead the pump pressure Pp to the pressure compensation valve 4 as the signal pressure when the hydraulic fluid flows through the relief line 61. Specifically, the switching valve 7 is connected to the relief line 61 by a first pilot line 73 at a position upstream of the restrictor 63, and connected to the relief line 61 by a second pilot line 74 at a position between the restrictor 63 and the relief valve 62. In other words, the switching valve 7 is connected to the downstream-side relay line 42 by the first pilot line 73 via the relief line 61 and the load pressure detection line 51. Accordingly, the switching valve 7 moves in accordance with the pressure difference between the pressure of the downstream-side relay line 42 and the pressure of the relief line 61 at a position between the restrictor 63 and the relief valve 62. Alternatively, the switching valve 7 may be directly connected to the downstream-side relay line 42 by the first pilot line 73.

If the pressure of the downstream-side relay line 42, i.e., the load pressure PL of the actuator 10, is lower than the setting pressure of the relief valve 62, the hydraulic fluid does not flow through the relief line 61, and the pressure of the first pilot line 73 and the pressure of the second pilot line 74 are equal to each other. Therefore, the switching valve 7 is positioned in its neutral position (right-side position in FIG. 2) by the spring force, and the maximum load pressure PLm is led from the maximum load pressure line 23 to the pressure compensation valve 4 via the first signal pressure line 71 and the second pilot line 44 as the signal pressure. Accordingly, the pressure compensation valve 4 moves in accordance with the pressure difference between the pressure of the upstream-side relay line 41 and the maximum load pressure PLm, and serves to keep constant the pressure difference between the upstream and downstream sides of the restrictor (the passage 30) of the control valve 3 (i.e., the pressure difference between the pump pressure Pp and the pressure of the upstream-side relay line 41). Therefore, even when the maximum load pressure PLm varies, the flow rate of the hydraulic fluid supplied to the actuator 10 is kept constant.

On the other hand, if the load pressure PL of the actuator 10 is higher than the setting pressure of the relief valve 62, the switching valve 7 shifts to a pressure-restricting position, which is the left-side position in FIG. 2, and leads the pump pressure Pp to the pressure compensation valve 4. Accordingly, the pressure compensation valve 4 blocks the upstream-side relay line 41 and the downstream-side relay line 42. Therefore, the load pressure PL of the actuator 10 can be kept to a desired pressure or lower.

As described above, in the pressure compensation unit 2A of the present embodiment, the load pressure PL of the actuator 10 can be kept to a desired pressure or lower. In addition, since the relief line 61 provided with the relief valve 62 is connected to the downstream-side relay line 42, even when one actuator 10 (pressure compensation unit 2A) is not operating and another actuator (pressure compensation unit 2A) is operating, the load pressure PL of the other actuator is not applied to the relief valve of the one actuator. This eliminates a problem where the hydraulic fluid of the operating pressure compensation unit 2A flows through the relief valve 62 of the non-operating pressure compensation unit 2A and is discharged. Thus, energy loss can be prevented.

Figure 4:
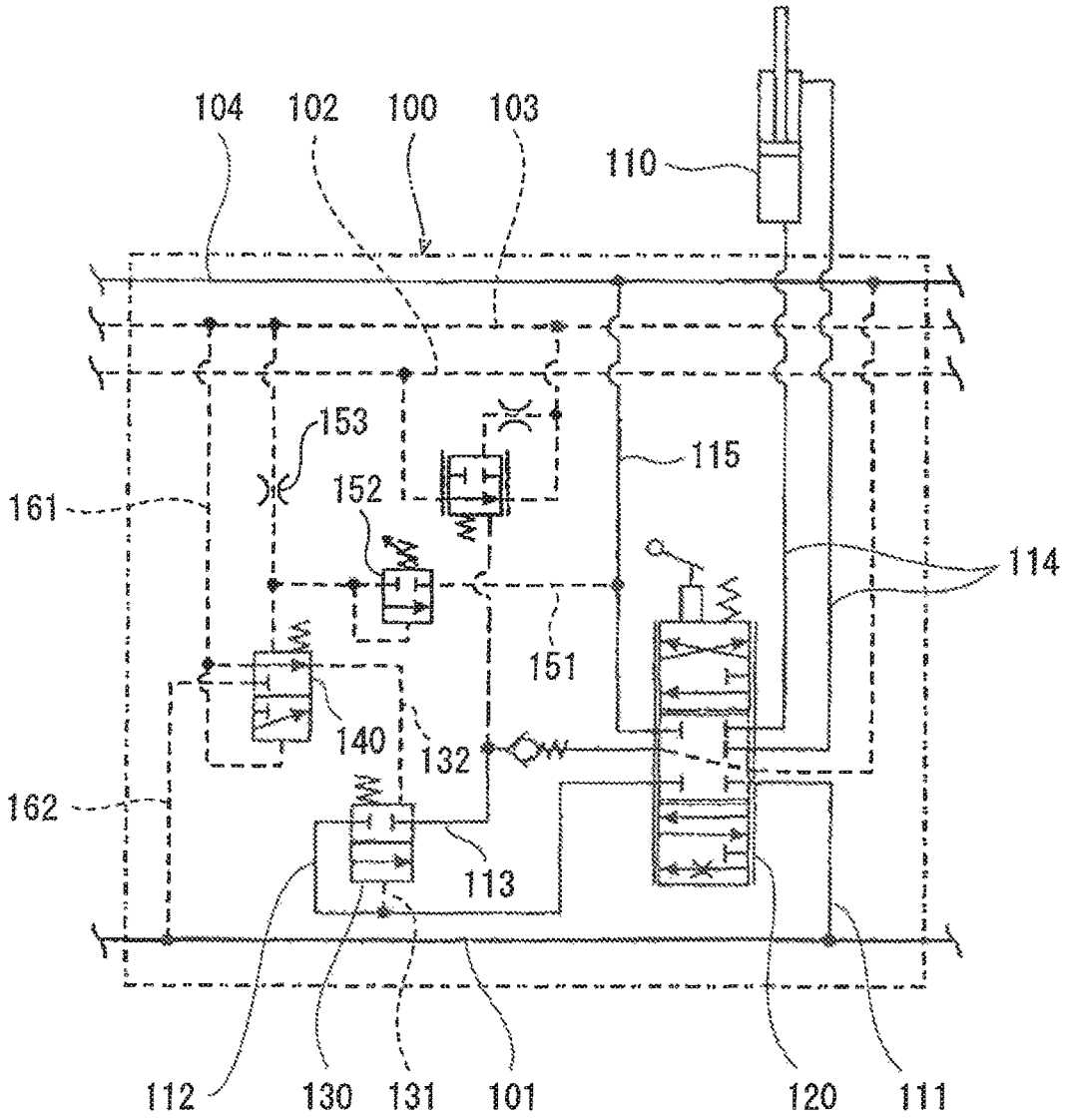
FIG. 4 shows a schematic configuration of a conventional pressure compensation unit.

In the conventional pressure compensation unit 100 shown in FIG. 4, the hydraulic fluid from the maximum load pressure line 103 is necessary for the switching of the switching valve 140. When the switching valve 140 shifts from the neutral position to the pressure-restricting position, i.e., when the relief valve 152 moves, flow rates that need to be supplied from the maximum load pressure line 103 are a flow rate discharged to the shared tank line 104 via the relief valve 152 and a flow rate corresponding to a necessary volume for the switching of the switching valve 140. That is, as a result of these flow rates being discharged from the maximum load pressure line 103, the pressure of the maximum load pressure line 103, i.e., the pressure led to the regulator of the pump, decreases temporarily. As a result, the discharge flow rate of the pump decreases. In the conventional pressure compensation unit 100, the relief valve 152 and the switching valve 140 (specifically, their pilot ports) provided for each actuator (i.e., for each pressure compensation unit) are connected to the maximum load pressure line 103. For this reason, there is a case where the flow rate discharged from the maximum load pressure line 103 becomes high, in which case the discharge flow rate of the pump decreases significantly. In this respect, in the present embodiment, the relief valve 62 and the switching valve 7

(specifically, their pilot ports) provided for each actuator (i.e., for each pressure compensation unit) are connected to the load pressure detection line 51 of the actuator. Therefore, unlike the conventional pressure compensation unit 100, the significant decrease in the discharge flow rate of the pump does not occur.

Further, in the conventional pressure compensation unit 100, there is a case where the pressure of the downstream-side relay line 113 increases to the pump pressure Pp due to leakage, or delay in the response, of the pressure compensation valve 130. In this respect, in the pressure compensation unit 2A of the present embodiment, since the relief line 61 provided with the relief valve 62 is connected to the downstream-side relay line 42, the pressure of the downstream-side relay line 42 can be prevented from increasing to the pump pressure Pp.

The switching valve 7 may be a solenoid valve. However, if the switching valve 7 is a pilot valve as in the present embodiment, the switching valve 7 can be moved automatically.

Embodiment 2

Figure 3:
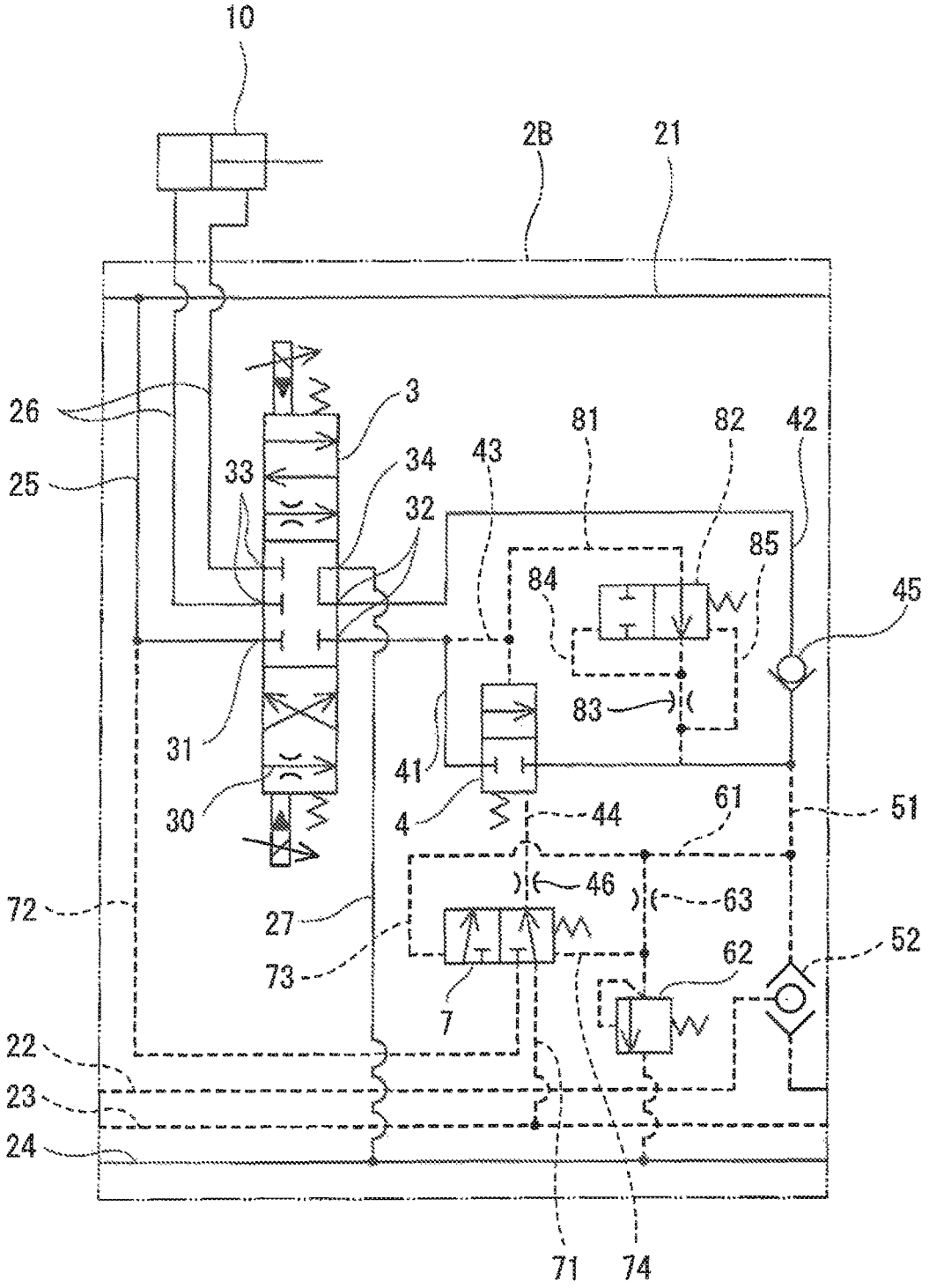
FIG. 3 shows a schematic configuration of a pressure compensation unit according to Embodiment 2 of the present invention.

Next, a pressure compensation unit 2B according to Embodiment 2 of the present invention is described with reference to FIG. 3. It should be noted that, in the present embodiment, the same components as those described in Embodiment 1 are denoted by the same reference signs as those used in Embodiment 1, and repeating the same descriptions is avoided below.

The pressure compensation unit 2B according to the present embodiment is a result of adding a bypass line 81 and a bypass valve 82 to the pressure compensation unit 2A of Embodiment 1. The bypass line 81 connects between the first pilot line 43 of the pressure compensation valve 4 and the downstream-side relay line 42. The bypass valve 82 serves to keep constant the flow rate of the hydraulic fluid that flows through the bypass line 81.

Specifically, the bypass line 81 is provided with a restrictor 83 positioned downstream of the bypass valve 82. The bypass valve 82 is connected to the upstream-side part of the restrictor 83 by a first pilot line 84, and connected to the downstream-side part of the restrictor 83 by a second pilot line 85. That is, the bypass valve 82 moves in accordance with the pressure difference between the pressure at the upstream-side part of the restrictor 83 and the pressure at the downstream-side part of the restrictor 83.

If the bypass line 81 and the bypass valve 82 are not provided, there is a case where the load pressure PL of the actuator 10 increases greatly even when the switching valve 7 moves. In this respect, if the bypass line 81 and the bypass valve 82 are provided, increase in the load pressure PL of the actuator 10 can be kept small assuredly.

Other Embodiments

The present invention is not limited to the above-described Embodiments 1 and 2. Various modifications can be made without departing from the spirit of the present invention.

For example, the high pressure selective valve 52 and the high pressure selective line 22 may be eliminated while the load pressure detection line 51 may be connected to the maximum load pressure line 23, and the load pressure detection line 51 may be provided with a check valve.

REFERENCE SIGNS LIST

10 actuator
2A, 2B pressure compensation unit
3 control valve
31 pump port
32 relay port
33 supply/discharge port
34 tank port
4 pressure compensation valve
41 upstream-side relay line
42 downstream-side relay line
43, 44 pilot line
51 load pressure detection line
61 relief line
62 relief valve
63 restrictor
7 switching valve
73 first pilot line
74 second pilot line
81 bypass line
82 bypass valve

The invention claimed is:

1. A pressure compensation unit comprising:
a control valve that controls supply and discharge of a hydraulic fluid to and from an actuator, the control valve including a pump port, a pair of relay ports, a pair of supply/discharge ports, and a tank port;
a pressure compensation valve connected to the pair of relay ports by an upstream-side relay line and a downstream-side relay line, the pressure compensation valve moving in accordance with a pressure difference between a pressure of the upstream-side relay line and a signal pressure;
a load pressure detection line that branches off from the downstream-side relay line;
a relief line connected to the downstream-side relay line and provided with a relief valve; and
a switching valve configured to:
lead a maximum load pressure to the pressure compensation valve as the signal pressure when the hydraulic fluid does not flow through the relief line; and
lead a pump pressure to the pressure compensation valve as the signal pressure when the hydraulic fluid flows through the relief line.

2. The pressure compensation unit according to claim 1, wherein
the relief line is provided with a restrictor positioned upstream of the relief valve, and
the switching valve is connected to the downstream-side relay line by a first pilot line, and connected to the relief line by a second pilot line at a position between the restrictor and the relief valve.

3. The pressure compensation unit according to claim 1, wherein
the pressure of the upstream-side relay line is led to the pressure compensation valve through a pilot line, and
the pressure compensation unit further comprises:
a bypass line that connects between the pilot line and the downstream-side relay line; and
a bypass valve provided on the bypass line and configured to keep constant a flow rate of the hydraulic fluid that flows through the bypass line.

4. The pressure compensation unit according to claim 2, wherein
the pressure of the upstream-side relay line is led to the pressure compensation valve through a pilot line, and
the pressure compensation unit further comprises:
a bypass line that connects between the pilot line and the downstream-side relay line; and a bypass valve provided on the bypass line and configured to keep constant a flow rate of the hydraulic fluid that flows through the bypass line.

* * * * *